US005509286A

United States Patent [19]

Coulon

[11] Patent Number: 5,509,286

[45] Date of Patent: Apr. 23, 1996

[54] METHOD AND APPARATUS FOR SURFACE TREATING AND PRESTRESSING THE INSIDE WALL OF A CAVITY

[75] Inventor: André Coulon, Bessoncourt, France

[73] Assignee: GEC Alsthom Electromecanique SA, Paris, France

[21] Appl. No.: 383,221

[22] Filed: Feb. 3, 1995

[30] Foreign Application Priority Data

Feb. 4, 1994 [FR] France ..... 94 01275

[51] Int. Cl.[6] ..... B24C 1/00

[52] U.S. Cl. ..... 72/53; 72/710; 451/76; 451/910

[58] Field of Search ..... 72/53, 710; 451/38, 451/39, 76, 77, 910

[56] References Cited

U.S. PATENT DOCUMENTS 5,085,747 2/1992 Nikano .

FOREIGN PATENT DOCUMENTS

2689431A1 10/1993 France .
3917380A1 12/1989 Germany .
0456704 1/1975 U.S.S.R. ..... 72/53
1435627 11/1988 U.S.S.R. ..... 72/53
1765207 9/1992 U.S.S.R. ..... 72/53
WO9213679 8/1992 WIPO .

OTHER PUBLICATIONS

*Database WPI,* Week 7915, Derwent Publications Ltd., London, GB; AN 79–D2749B/15 & SU–A–608 564 (Stebelkov) 24 May 1978.

*Database WPI,* Week 9035, 10 Oct. 1990, Derwent Publications, Ltd., London, GB; AN 90–266661/35 & SU–A–1 521 564 (Lengd Turbine Blade) 15 Nov. 1989.

*Primary Examiner*—David Jones
*Attorney, Agent, or Firm*—Sughrue, Mion, Zinn, Macpeak & Seas

[57] ABSTRACT

The present invention relates to a method and apparatus for surface treating and putting under compression prestress the inside wall of a cavity, in particular a cylindrical cavity of circular section. The apparatus comprises a bulb-shaped vibrator provided with a tubular portion designed to be engaged in an orifice of a cavity to be treated. It is associated with a vibration exciter designed to excite the vibrator at its resonant frequency. The treatment is obtained by shot in the form of balls being projected against the walls of the cavity and returned into the treatment field by a reflector. The method is particularly applicable to treating holes that are designed to receive the fixing pins of turbine blades.

13 Claims, 2 Drawing Sheets

METHOD AND APPARATUS FOR SURFACE TREATING AND PRESTRESSING THE INSIDE WALL OF A CAVITY

The present invention relates to a method of surface treating and prestressing in compression the inside wall of a cavity including at least one orifice, of a tube, of a bore, or of a hole machined in a mechanical part.

The invention also relates to apparatus for implementing the method.

BACKGROUND OF THE INVENTION

Improving the surface state of a cavity, a tube, a bore, or a hole machined in a mechanical part, and putting said surface into compression are known to the person skilled in the art. For example, it is possible to achieve these objectives by blasting with sand or with corundum. However, the effects of those methods are limited and it is more common practice to blast with shot, using balls of steel, glass, or ceramic. Those known methods are ineffective for treating certain surfaces, in particular the walls of a cavity of small dimensions, and more particularly the walls of a machined hole, bore, or tube of longitudinal dimensions that are much greater than its transverse dimensions. Ordinary shot-blasting by firing balls through nozzles pointing towards the part to be treated give no results on the walls of a cavity as defined above, given that the only way the balls can travel inside the cavity is along a direction that is substantially parallel to the walls that are to be treated. Since the balls do not strike the walls, or at least not hard enough to provide effective surface treatment, that method cannot be used successfully under such circumstances.

Such a situation arises, in particular, in the field of manufacturing turbines, and more particularly when mounting turbine blades in the disk of a rotor. Mounting is performed by using pins to hold together two interfitting combs, i.e. the comb of the blade and the comb of the disk are held together by two or three fixing pins that pass right through the interfitting combs.

Normal blade mounting consists in independently providing initial holes of smaller diameter than the final holes both in the blade and in the disk, prior to the blade being installed on the disk. Each hole is machined to size by means of a tool such as a reamer, for example. However, the surface state of each hole is of mediocre quality, and because the tool work hardens the metal around the hole tangentially, it sets up residual traction stresses that give rise to high sensitivity to cracking under stress and to increased sensitivity when corrosion is possible. That is why it is essential to improve the surface state, particularly whenever it is necessary for the mounting to be highly reliable.

OBJECTS AND SUMMARY OF THE INVENTION

The method of the invention seeks to mitigate the drawbacks of the prior art and makes it possible to improve the surface state sufficiently to satisfy the most exacting requirements in fields where quality is synonymous with safety.

This object is achieved by the method of the invention wherein ultrasonic shot-blasting is performed by inserting shot made up of balls of a determined diameter in said cavity and by putting the balls into vibratory resonance by means of a vibrator. The vibrator, sometimes known as a sonotrode, is a bulb-shaped device, made of a material that has little capacity to damp vibration (e.g. titanium) and that is designed to amplify or sustain vibratory motion. It is disposed in the vicinity of said orifice of said cavity and it is excited by a vibration exciter.

Preferably, a bulb-shaped vibrator is used that has an enlarged portion and a tubular portion, and said vibrator is excited at its resonant frequency or at one of its resonant frequencies.

When such a vibrator is used, the free end of said tubular portion is inserted a little way into said cavity.

It is also possible to use a vibrator in which the free end of said tubular portion is provided with a thrust flange and under such circumstances, the flange is pressed against the material surrounding said orifice of said cavity.

When the cavity is a through cavity, a reflector is pressed against a second orifice at the opposite end thereof to the said orifice adjacent which the vibrator is disposed, the vibrator being organized to return balls back into the cavity.

Preferably, the reflector is in the form of a plate made of a metal or a metal alloy that is identical to that of the vibrator.

Advantageously, the dimensions of the vibrator are determined in such a manner as to obtain a vibration node in the enlarged portion and a vibration antinode at the free end of the tubular portion.

When the tube is held in place by tube expansion, a jet of compressed air is injected via a second orifice opposite said orifice close to which the vibration is disposed so as to limit the field of displacement of the balls.

To achieve the same object, the apparatus of the invention comprises a vibrator, a vibration exciter organized to excite the vibrator, and shot constituted by balls of predetermined diameter, said balls being designed to be put into vibratory resonance inside said cavity when the vibrator is mounted in the vicinity of the orifice of said cavity and is excited by said vibration exciter.

In the preferred embodiment of the apparatus, the vibration exciter is organized to excite the vibrator at its resonant frequency or at one of its resonant frequencies.

In this embodiment, said vibrator includes an enlarged portion and a tubular portion and its dimensions are selected so that a vibration node forms in its enlarged portion and a vibration antinode forms at the free end of its tubular portion.

Preferably, said tubular portion has a free end whose transverse size is slightly smaller than the transverse size of the orifice of said cavity.

In a variant embodiment, said tubular portion includes a thrust flange at its free end.

Advantageously, the apparatus includes a reflector designed to be pressed against a second orifice of said cavity opposite from said orifice in the vicinity of which the vibrator is disposed.

BRIEF DESCRIPTION OF THE DRAWINGS

The present invention will be better understood on referring to the following description of embodiments and to the accompanying drawings, in which.

MORE DETAILED DESCRIPTION

Figure 2:
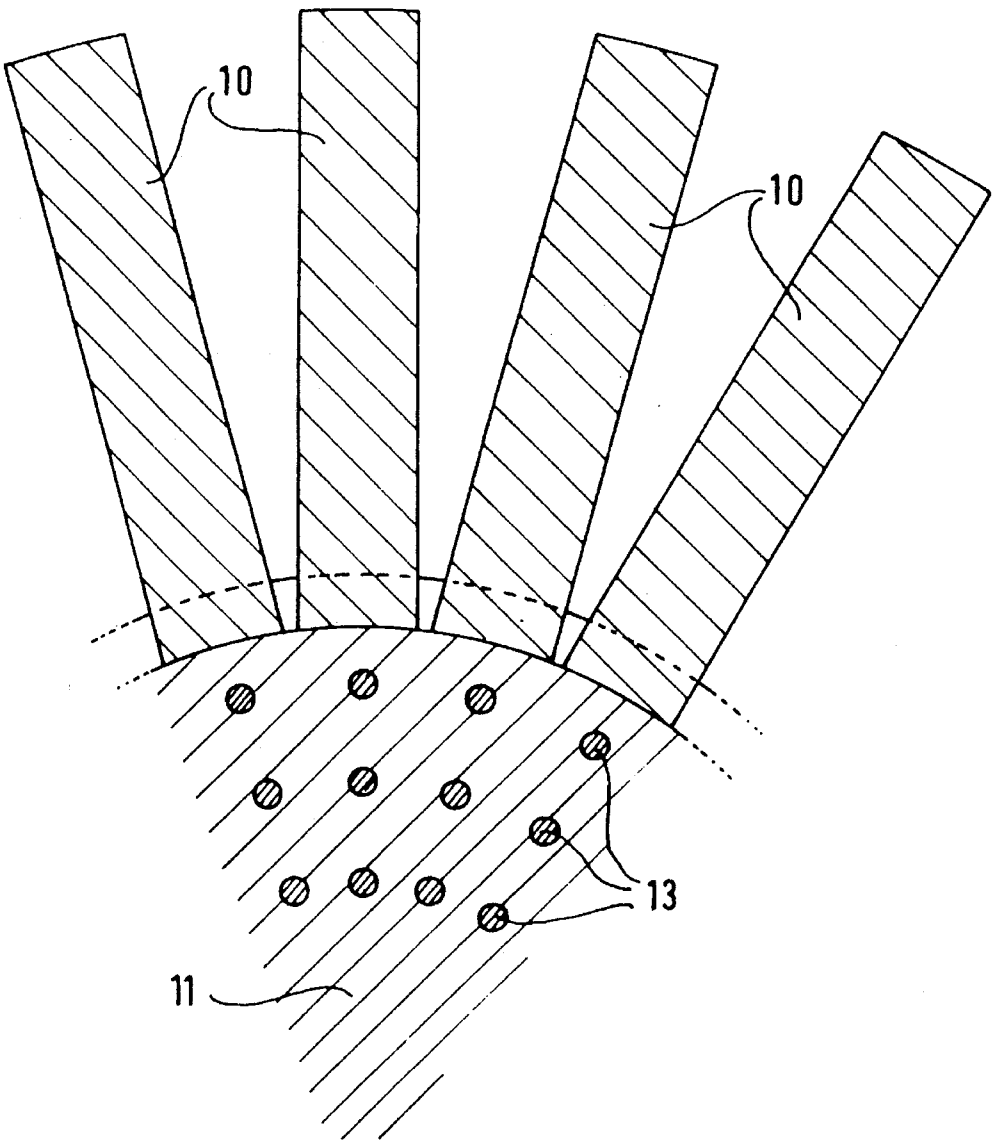
FIG. 2 is a section view on a plane perpendicular to the axis of the FIG. 1 turbine disk.
Figure 1:
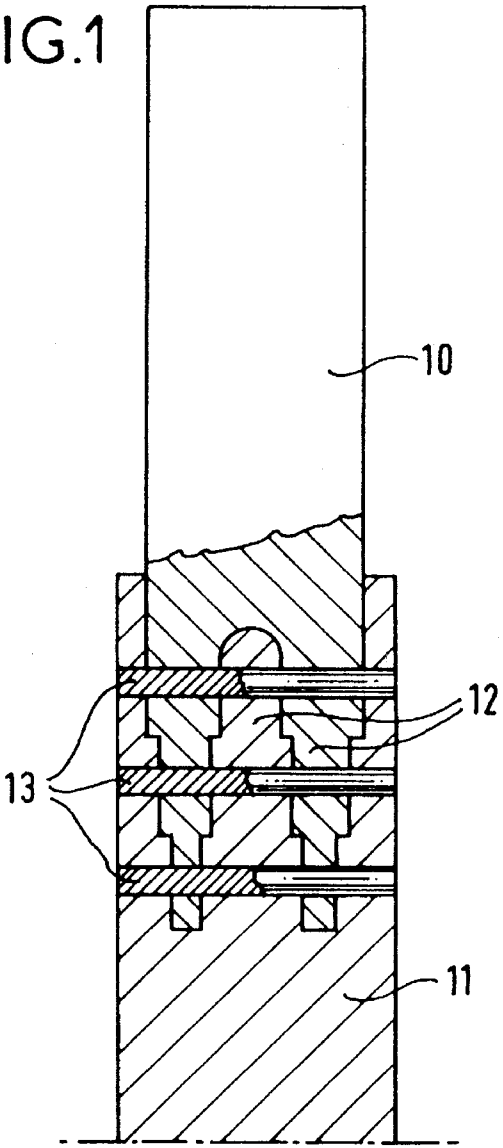
FIG. 1 is a radial section view through a turbine disk in which a turbine blade is installed.

With reference to FIGS. 1 and 2, turbine blades 10 are mounted on a disk 11 by means of two interfitting combs 12, and they are secured to the disk, e.g. by means of three pins 13 which are driven into appropriate bores formed through the disk 11 and the interfitting combs 12. Since the bore must be very accurate and since its surface state is critical, it is necessary to subject the inside wall of the cavity defined by said bore to surface treatment, and to ensure that it is under compression stress.

Figure 3:
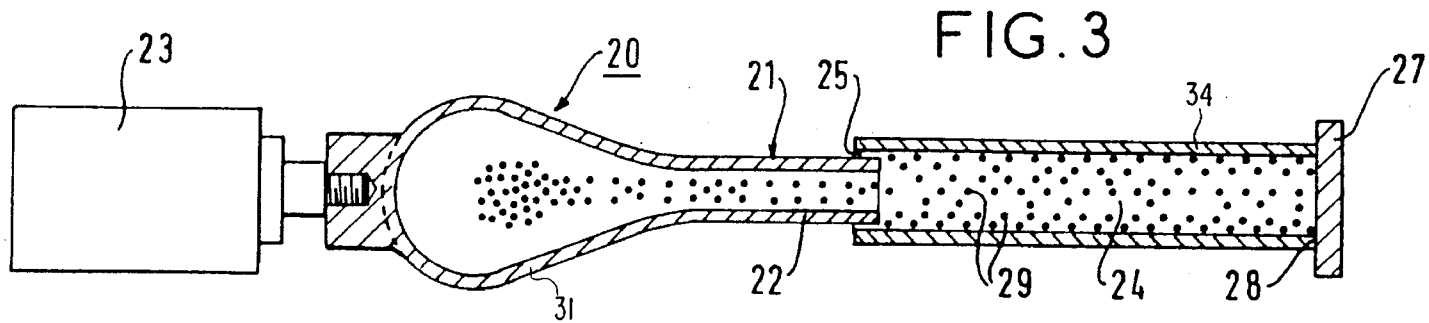
FIG. 3 is an axial section through a first embodiment of the apparatus of the invention.
Figure 4:
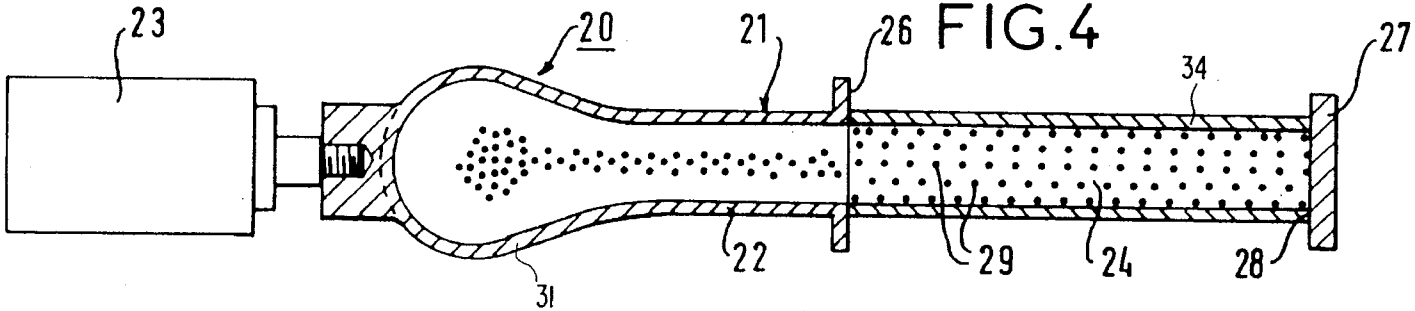
FIG. 4 is an axial section through a second embodiment of the apparatus of the invention.

Two embodiments of the apparatus used are shown in FIGS. 3 and 4.

The apparatus essentially comprises a hollow, bulb-shaped vibrator 20 having a radially enlarged closed end portion 31 integral with a second end 21 defined by a small, diameter tubular element 22 of determined length. A high frequency vibration exciter 23 is coupled to the vibrator for the purpose of exciting it. To obtain the desired surface treatment of the inside wall of a cavity 24 of a workpiece 34, the assembly comprising the vibrator 20 and the vibration exciter 23 is placed at one orifice 25 of the cavity. In the embodiment shown in FIG. 3, the tubular element 22 of the vibrator 20 is slightly smaller in diameter than the cavity 24 and its open end is inserted a few millimeters into said cavity. In the embodiment shown in FIG. 4, the tubular element 22 of the vibrator 20 is provided with a flange 26 of annular shape surrounding the free end of said element. This variant makes it possible to use the vibrator with workpiece cavities of different diameters. The flange is pressed against the wall surrounding the orifice 25.

In the example shown, the cavity 24 is a through hole within the workpiece 34 so a reflector 27 is used to close the orifice 28 opposite to the orifice 25. The reflector is constituted by a plane plate which is preferably made of the same metal as the vibrator, e.g. of titanium or titanium alloy. For a tube secured by tube expansion, the reflector may be replaced by a jet of compressed air directed into the tube to limit the displacement field of the balls. The surface treatment proper is performed by the balls 29 which are preferably made of steel and are previously placed in the cavity, and which are set into vibration by the vibrator 20 which produces vibratory resonance under excitation from the vibration exciter 23. The length and the diameter of the vibrator, and in particular of its tubular element 22 are selected in such a manner that one of its resonant frequencies is well determined and lies in the range 10 MHz to 30 MHz, and is preferably approximately equal to 20 MHz. The material used for making the vibrator is a metal or a metal alloy that has a low damping coefficient in vibration, such as titanium for example. The reflector 27 is used to reflect the balls 29 back into the field to be treated.

Figure 5:
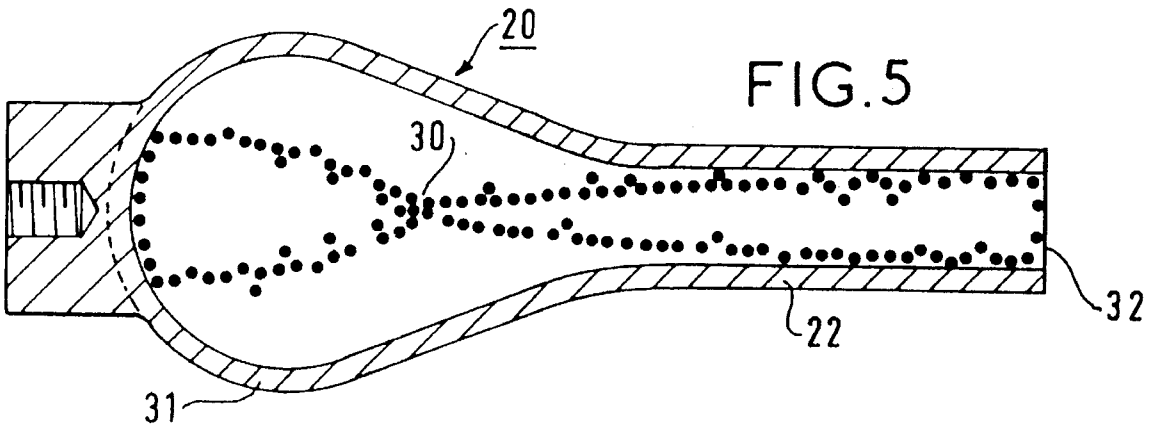
FIG. 5 is an axial section through the vibrator and illustrates the principles on which it operates.

FIG. 5 shows the vibrator 20 in axial section and shows how it operates. The vibrator is excited at its resonant frequency or at one of its resonant frequencies. The node or one of the vibration nodes 30 occurs in the radially enlarged portion 31. The vibration antinode or one of the vibration antinodes 32 is situated at the end of the tubular element 22. The length of the tubular element is designed so that a vibration antinode corresponds to its end from which balls are injected into the cavity.

Under the effect of the vibrator being excited, the balls are put into very violent motion and they strike the walls that are to be shot-blasted in all directions, and a very large number of times, thereby hammering said walls to a considerable extent and as a result erasing the traces of the reamer while establishing residual compression stresses over a thickness that can be greater than the thickness achieved by conventional shot-blasting.

Ultrasound shot-blasting has many advantages over conventional shot-blasting: the balls are observed to suffer much less wear so they remain spherical much longer. Since the impacts are multidirectional, whereas with conventional shot-blasting the balls are projected in one direction only, the field of residual compression stress is isotropic. Consequently, ultrasound shot-blasting achieves a better final surface state and provides compression over a thickness that is greater than that achieved by conventional shot-blasting.

The present invention is not limited to the embodiments described above, but may be modified in various ways and may be presented in various manners that are obvious to the person skilled in the art.

I claim:

1. An ultrasound shot-blasting method for treating and putting under compression prestress an inside wall of a cavity within a workpiece having a longitudinal cavity dimension much greater than a transverse dimension thereof, the cavity having at least one orifice, said method comprising:

exciting a high frequency vibration within a high frequency exciter coupled to a closed end radially enlarged portion of a hollow bulb integral with a coaxial, reduced diameter tubular element terminating in an open, free end adapted to contact said at least one orifice of said workpiece cavity upon alignment therewith, setting balls of determined diameter within said hollow bulb-shaped vibrator into vibration at a resonant frequency of said bulb-shaped vibrator, and causing vibrating balls to move from said hollow bulb-shaped vibrator through said free end of said tubular element and said at least one orifice into said cavity for shot-blasting the cavity inside wall of said workpiece by radial impingement.

2. The method according to claim 1, further comprising the step of inserting the free open end of said tubular element a short distance into said cavity through said orifice.

3. The method according to claim 1, further comprising the step of pressing the open end of said tubular element against said workpiece about said orifice.

4. The method according to claim 1, wherein said at least one orifice comprises a plurality of orifices, and said method further comprises closing each of said orifices by a removable reflector, except the orifice connected to said bulb-shaped vibrator.

5. The method according to claim 1, wherein said at least one orifice comprises a plurality of orifices, and said method further comprises injecting a jet of compressed air into the cavity through said plurality of said orifices, except the orifice connected to said bulb-shaped vibrator.

6. The method according to claim 1, wherein dimensions of said radially enlarged portion and said tubular portion are selected in such a manner as to obtain a vibration node in said radially enlarged portion and a vibration antinode at said free open end of said tubular portion.

7. An apparatus for treating and putting under compression prestress an inside wall of a cavity within a workpiece having a longitudinal cavity dimension much greater than a transverse dimension thereof, the cavity having at least one orifice, said apparatus comprising a hollow bulb-shaped vibrator coupled to a high frequency vibration exciter, said hollow bulb-shaped vibrator having a radially enlarged portion opening to and extended by a tubular portion forming a tubular neck, said tubular neck having a free open end opposite to said radially enlarged portion, and a set of balls of a predetermined diameter within said hollow bulb-shaped vibrator, whereby upon subjecting said hollow bulb-shaped vibrator to high frequency vibration, said hollow bulb-shaped vibrator may be set into vibratory resonance to cause said balls under vibration to move from said hollow bulb-shaped vibrator through said free end of said tubular element and said at least one orifice into said cavity for shot-blasting the cavity inside wall of said workpiece.

8. The apparatus according to claim 7, wherein said high frequency vibration exciter comprises means for operating said bulb-shaped vibrator at a resonant frequency thereof.

9. The apparatus according to claim 7, wherein said free open end of said tubular element has a diameter slightly smaller than said orifice of said workpiece cavity.

10. The apparatus according to claim 7, wherein said tubular element at said free open end is provided with a radially outwardly projecting annular flange.

11. The apparatus according to claim 7 for use with said workpiece, wherein said workpiece includes a plurality of cavity orifices, and said apparatus further comprises reflectors for pressing against one of said orifices of said cavity not adapted for contact with the bulb-shaped vibrator.

12. The apparatus according to claim 11, wherein said bulb-shaped vibrator and said reflector are made of a same material.

13. The apparatus according to claim 7, wherein the dimensions of said radially enlarged portion and said tubular portion of said hollow bulb are selected in such a manner as to obtain a vibration node in said radially enlarged portion and a vibration antinode at said free open end of said tubular portion.

* * * * *